US006131738A

United States Patent [19]

DeJonge

[11] Patent Number: 6,131,738

[45] Date of Patent: Oct. 17, 2000

[54] BREAKAGE PREVENTION DEVICE FOR BLISTER PACKS

[75] Inventor: Stuart W. DeJonge, Easton, Pa.

[73] Assignee: Valley Design Inc., Bloomsbury, N.J.

[21] Appl. No.: 09/235,659

[22] Filed: Jan. 22, 1999

[51] Int. Cl.[7] ..... B65D 83/04; B65D 85/42; B65D 1/09; B65D 73/06

[52] U.S. Cl. ..... 206/528; 206/531; 206/538; 206/484.2

[58] Field of Search ..... 206/528, 531, 206/532, 535, 538, 484, 484.1, 484.2, 522, 229, 461, 521, 585; 220/23.4; 294/87.2; 249/160; 2/15, 445, 426

[56] References Cited

U.S. PATENT DOCUMENTS

| | | | |
|---|---|---|---|
| 2,780,353 | 2/1957 | Volckening | 206/65 |
| 2,949,204 | 8/1960 | Edwards | 220/23.4 |
| 3,302,854 | 2/1967 | Midgley et al. | 206/526 |
| 3,331,495 | 7/1967 | Leckzik et al. | 206/531 |
| 4,434,893 | 3/1984 | Barlow | 206/522 |
| 4,741,441 | 5/1988 | Keffeler | 206/532 |
| 4,753,352 | 6/1988 | Dauphin et al. | 206/538 |
| 5,019,125 | 5/1991 | Rebne | 206/532 |
| 5,030,501 | 7/1991 | Colvin et al. | 206/522 |
| 5,150,793 | 9/1992 | Tannenbaum | 206/531 |
| 5,265,728 | 11/1993 | Allendorf | 206/534 |
| 5,318,824 | 6/1994 | Itaya et al. | 206/538 |
| 5,325,961 | 7/1994 | Ford | 206/229 |
| 5,794,781 | 8/1998 | Roulin et al. | 206/531 |
| 5,833,070 | 11/1998 | Mizuno et al. | 206/524.4 |

*Primary Examiner*—Paul T. Sewell
*Assistant Examiner*—Anthony Stashick
*Attorney, Agent, or Firm*—Kenneth P. Glynn, Esq.

[57] ABSTRACT

The present invention is a protective system for a plurality of pills contained within a blisterpack. It includes a plurality of hollow modules formed of a non-flexible plastic material, each hollow module having a sufficient size and shape to fit over individual blister-contained pills in the blister pack, and a plurality of spacing bars connecting the plurality of modular hollow modules. The hollow modules may be arranged in predetermined geometric patterns linearly or in an x-axis, y-axis plane to coincide with the pattern of blisters of a blisterpack so as to fit over the blisterpack for packaging and shipping to prevent breakage and damage to the blisters and the pills contained therein.

20 Claims, 3 Drawing Sheets

BREAKAGE PREVENTION DEVICE FOR BLISTER PACKS

BACKGROUND OF THE INVENTION

1. Field of the Invention

The present invention is a breakage prevention device or system which utilizes ridgedly formed, non-pierceable plastic modules set up in a predetermined geometric arrangement to protect individual pills in a blister pack without being attached to the blister pack. These modules protect the individual pills much like an inverted cup would protect an egg.

2. Information Disclosure Statement

The following patents are representative of the prior art for protecting pills in blister packs:

U.S. Pat. No. 2,780,353 to Llyod I. Volckening describes a crush resistant package which functions much like a book of matches to protect pills contained within a pack.

U.S. Pat. No. 4,434,893 to Gordon A. Barlow describes a tamper evident packaging for contaminatable products. The packaging includes inner and outer gas-tight containers. In one embodiment, the inner container has only one flexible wall and the outer container has only one flexible wall. The inner and outer containers are each pressurized with gas above atmospheric pressure to inflate their flexible walls. In another embodiment of the invention, both walls of each of the inner and outer containers are flexible. The capsules, pill and the like to be protected are located inside the inner container and the inner container is positioned inside the outer container providing a package which is difficult to tamper with and will clearly show evident of tampering both through appearance and characteristic feel to the would be purchaser.

U.S. Pat. No. 4,741,441 to Paul J. Keffeler describes a medication dispenser which includes a reusable container adapted to receive one or more disposable multicompartment liners for sanitary storage of medication out of contact with the reusable container. The open-topped compartments of the liner are closed by individual covers which are locked onto the container with a fracturable tab which must be broken to open a compartment. The covers are designed to form an air-tight seal with the liner compartments for tamper-proof sanitary air-tight storage of a patient's medication.

U.S. Pat. No. 5,019,125 to Thomas M. Rebne et al. describes a solid medicament dispensing device having a cover and tray to provide a container for a cartridge for the solid medicament. The cover has hinged panel members and the tray an opening in the floor. When the hinged panel members are moved against the cartridge, it forces the medicament out of the cartridge and through the tray opening. The dispensing device is particularly suited for dispensing large dosages of capsules.

U.S. Pat. No. 5,150,793 to Michael A. Tannenbaum describes a device for inhibiting removal of an article from a blister-type container having at least one blister. The device includes a housing surrounding at least a portion of the container sized to permit movement of the container between first and second positions. The housing has a base positioned facing the blister-type container with at least one base opening in registry with the blister when the container is in the first position. The base opening is sized to permit passage of the article therethrough. The device also includes a biasing member for biasing the container toward the second position. When the container is in the second position, the base of the housing is positioned to inhibit removal of the article from the container. When the container is moved by an individual against the bias of the biasing member to the first position, the blister is in registry with the base opening to permit removal of the article by applying pressure to the outside surface of the blister to force the article to rupture the container and pass through the base opening.

U.S. Pat. No. 5,265,728 to Stephan C. Allendorf et al. describes an arrangement for retaining blister pack tablets comprising a container with at least a front cover and a rear cover with a blister pack sandwiched therebetween and visible through a window in the front cover. The blister pack includes indicia thereon indicating the order in which the tablets should be taken and the container includes a pointer identifying the first tablet in the array of tablets to be consumed. Preferably, the container includes a daily calendar in the form of a loop or cylinder which is moveable with respect to the container so that a desired starting day can be selected by the user or prescriber. Preferably, the loop or cylinder is lockable in its selected position. In accordance with two embodiments of the invention, front and rear lids are pivoted to the front and rear covers, respectively, to conceal the blister pack until it is necessary to take a tablet.

U.S. Pat. No. 5,325,961 to John M. B. Ford et al. describes a blister package for a cosmetic article which provides a means to include and protect an applicator while permitting the viewing of the cosmetic. The package comprises a support panel on which are mounted first and second blisters adapted to confine a cosmetic applicator and article, respectively. The first blister is mountable on the support panel confining the applicator and providing support for the cosmetic article while protecting the applicator from crushing and contamination. The second blister is mountable over the first blister, and the cosmetic article supported thereon, in a manner which allows the cosmetic article to be opened and the cosmetic therein viewed while preventing access to the cosmetic.

Notwithstanding the prior art, the present invention is neither taught nor rendered obvious thereby.

SUMMARY OF THE INVENTION

The present invention is a protective system for a plurality of pills contained within a blisterpack. It includes a plurality of hollow modules formed of a non-flexible plastic material, each hollow module having a sufficient size and shape to fit over individual blister-contained pills in the blisterpack, and a plurality of spacing bars connecting the plurality of modular hollow modules. The hollow modules may be arranged in predetermined geometric patterns linearly or in an x-axis, y-axis plane to coincide with the pattern of blisters of a blisterpack so as to fit over the blisterpack for packaging and shipping to prevent breakage and damage to the blisters and the pills contained therein.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention is directed to breakage protection of blisterpack packaged items such as medicinal pills and capsules. More specifically, it is a device or system utilizing a plurality of hollow modules connected to one another by spacing bars. They are formed of non-flexible (rigid plastic) of sufficient strength to prevent inadvertent breakage of a blister unit and/or its contents, prior to intended dispensing, e.g. during shipping. The system in one usage is the device itself, and in another usage is the combination of the device with a blisterpack. The modules are hollow and are arranged in size and shape in a predetermined geometric pattern to accommodate an array of blisters on a blisterpack. The spacing bars are used to both enhance strength and set proper positioning of each module relative to the blisters in a given blisterpack. While the devices are not physically attached to the blisterpack, they fit over and rest upon the blisterpack and may be held in place by outside packaging, much as a plastic bag snugly fits or a plastic wrap. Alternatively, the devices could be taped or otherwise temporarily attached, but this is not a necessary feature of the invention.

Figure 1:
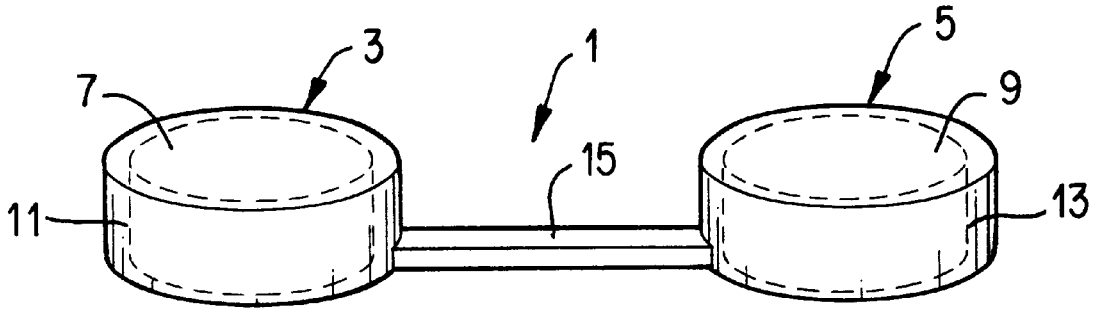
FIG. 1 shows a front oblique view of one embodiment of a present invention device.

FIG. 1 shows a front oblique view of present invention breakage prevention device 1 with individual hollow modules 3 and 5 and spacing bar 15 therebetween. Hollow module 3 has a top 7 which is generally flat and a circular side-wall 11, rendering it cylindrical. Likewise, hollow module 5 has a top 9 and a side-wall 13 with an identical shape as hollow module 3. Spacing bar 15 is a sliderod of a predetermined length and functions to both support the two hollow modules 3 and 5 structurally and so as to set the spacing distance between hollow modules 3 and 5 so that hollow modules 3 and 5 will fit directly over blistered pills of the same separation distance as device 1's hollow module 3 and 5. Likewise, the size of the hollow areas of hollow modules 3 and 5 must be sufficient to fit over the blisters of blistered pills.

Figure 2:
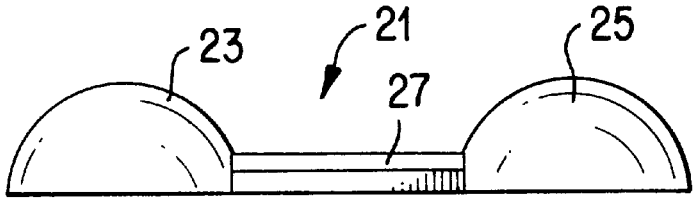
FIGS. 2, 3 and 4 show front, cutside and top views respectively of another present invention device.
Figure 3:
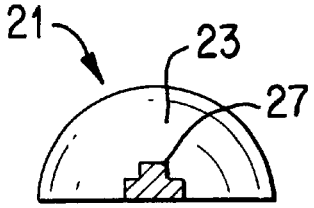
Figure 4:
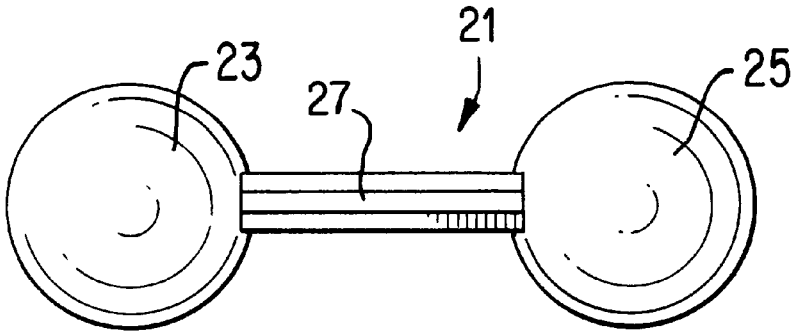
Figure 5:
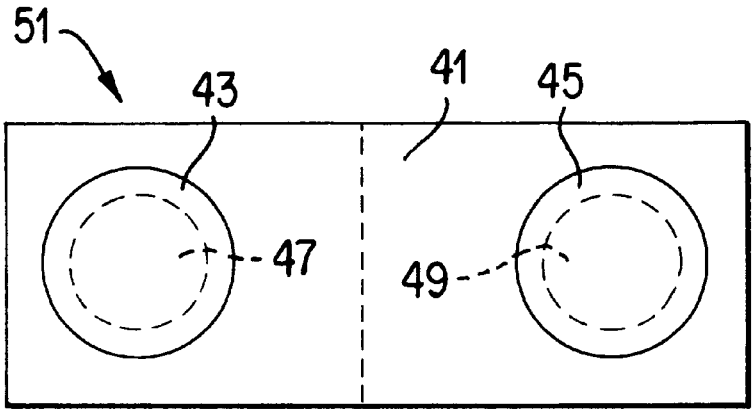
FIG. 5 shows a top view of a blisterpack.

FIGS. 2, 3 and 4 illustrate front, cut end and top views of present invention device 21, which includes two semi-spherical hollow modules 23 and 25 and spacing bar 27 in the form of a solid inverted "T" structure. The hollow modules 23 and 25 are spaced and sized so as to fit over two blister pack pills such as shown in FIG. 5. Thus, blister pack 51 of FIG. 5 includes foil 41 with pills 47 and 49 covered in a plastic blister layer which includes blisters 43 and 45.

Figure 6:
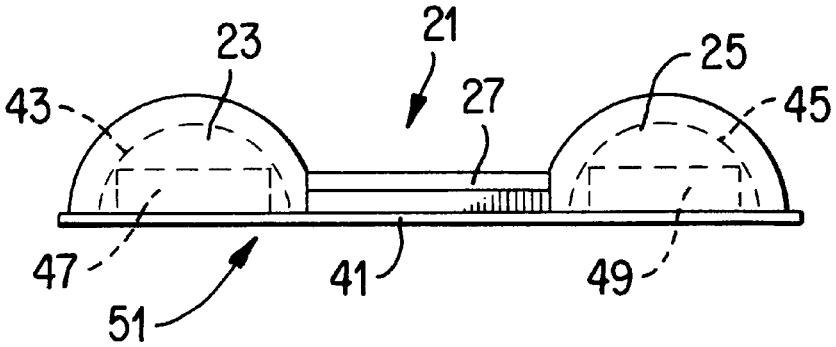
FIG. 6 shows a side view of a present invention system utilizing the FIG. 2 device with the FIG. 5 blisterpack; and, FIGS. 7 and 8 show top views of two alternative embodiment present invention devices.

FIG. 6 shows a side view of present invention device 21 positioned atop blister pack 51 with identical parts from the previous Figures identically numbered. As can be seen from FIG. 6, present invention device 21 prevents damage or crushing to blisters 43 and 45 and prevents inadvertent dispensing of pills 47 and 49 from blister pack 51. As shown in FIG. 6, present invention device 21 and blister pack 51 could be packaged in a tight plastic wrap or plastic bag or small cardboard box or otherwise, which would then maintain present invention device 21's position relative to blister pack 51.

Figure 7:
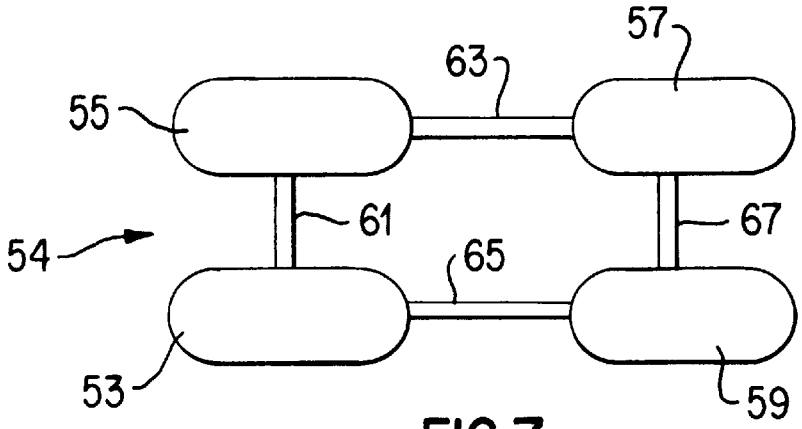
Figure 8:
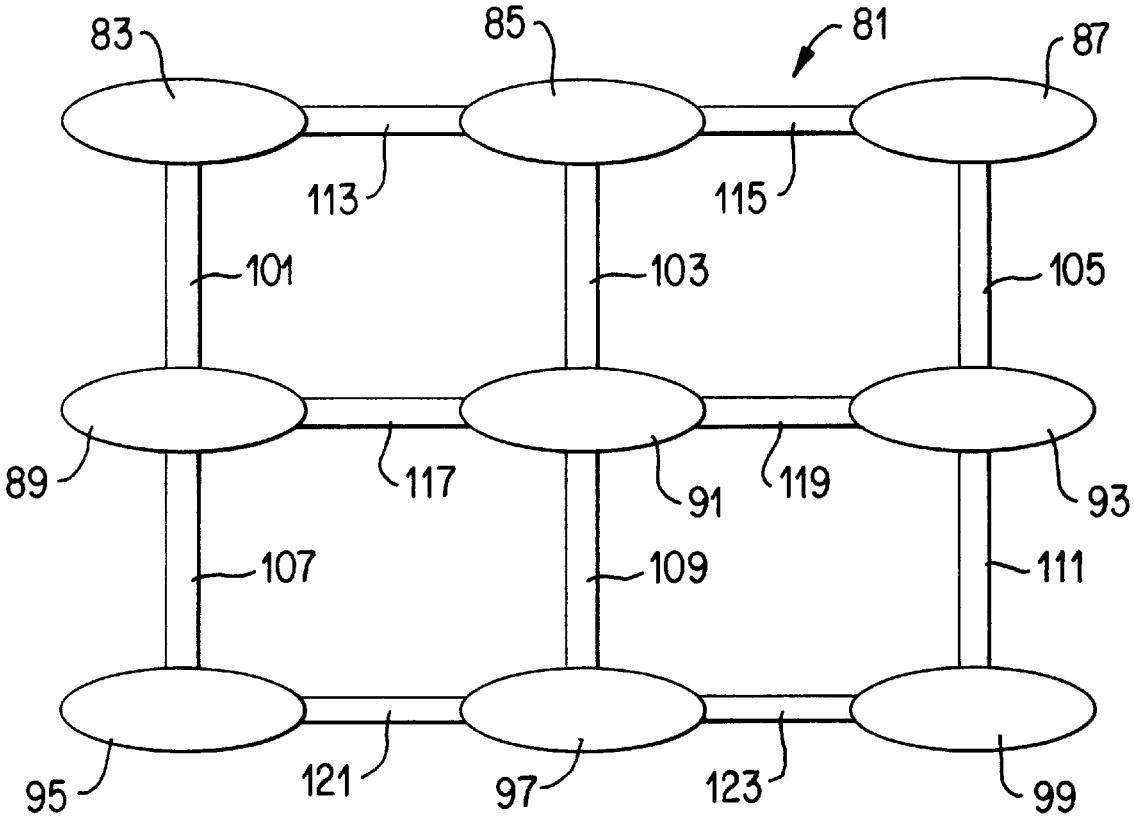

FIGS. 7 and 8 show alternative present invention devices in their top views. Thus, FIG. 7 shows a top view of device 54 which includes capsule-shaped hollow modules 53, 55, 57 and 59. These are interconnected by spacing bars 61, 63, 65 and 67. These spacing bars provide structural integrity and appropriate spacing. In this embodiment every module is connected by a spacing bar to all adjacent modules.

FIG. 8 shows a top view of device 81 which includes oval capsule-shaped hollow modules 83, 85, 87, 89, 91, 93, 95, 97 and 99. These are interconnected by spacing bars 101, 103, 105, 107, 109, 111, 113, 115, 117, 119, 121 and 123. These spacing bars provide structural integrity and appropriate spacing. In this embodiment every module is connected by a spacing bar to all adjacent modules which are located in rows and columns, as shown.

The present invention devices shown in FIGS. 7 and 8 would function in a similar fashion to the arrangement shown in FIG. 6, but would cover different shaped blisters and different numbers and spacing of pills, but would otherwise be used in the same manner for the same purpose.

Obviously, numerous modifications and variations of the present invention are possible in light of the above teachings. It is therefore understood that within the scope of the appended claims, the invention may be practiced otherwise than as specifically described herein.

What is claimed is:

1. A protective blisterpack system which comprises:

a) a blisterpack containing a plurality of pills, said blisterpack having a predetermined, consistent shape for all pills contained therein, arranged in a predetermined geometric pattern: and, b) a plurality of hollow modules formed of a nonflexible plastic material, each hollow module having sufficient size and shape to fit over individual blister contained pills in said blisterpack, and a plurality of spacing bars connecting said plurality of hollow modules.

2. The system of claim 1 wherein said spacing bars have a predetermining length for spacing said hollow modules so as to position said hollow modules at the same distances apart and in the same positions as said individual blister contained pills in said blisterpack.

3. The system of claim 1 wherein said hollow modules are aligned linearly, wherein there are N number of hollow modules and wherein there are N−1 number of spacing bars.

4. The system of claim 1 wherein said hollow modules are arranged in a two dimensional array in an x-axis, and y-axis plane, and there is a sufficient number of spacing bars to connect each hollow module to all x-axis, and y-axis adjacent hollow modules.

5. The system of claim 1 wherein said spacing bars have a T-bar cross section so as to enhance the strength of said spacing bars.

6. The system of claim 3 wherein said spacing bars have a T-bar cross section so as to enhance strength of said spacing bars.

7. The system of claim 4 wherein said hollow modules are aligned linearly, wherein there are N number of hollow modules and wherein there are N−1 number of spacing bars.

8. The system of claim 4 wherein said hollow modules are semi-spherical.

9. The system of claim 1 wherein said hollow modules are cylindrical.

10. The system of claim 1 wherein said hollow modules are elongated with rounded ends.

11. A protective system for a plurality of pills contained within a blisterpack, said system comprising:

a plurality of hollow modules formed of a nonflexible plastic material, each hollow module having sufficient size and shape to fit over individual blister contained pills in a blisterpack, and a plurality of spacing bars connecting said plurality of modular hollow modules and adapted to support said plurality of modular hollow modules.

12. The system of claim 11 wherein said spacing bars have a predetermining length for spacing said hollow modules so as to position said hollow modules at the same distances apart and in the same positions as individual blister contained pills in a blisterpack.

13. The system of claim 11 wherein said hollow modules are aligned linearly, wherein there are N number of hollow modules and wherein there are N−1 number of spacing bars.

14. The system of claim 11 wherein said hollow modules are arranged in a two dimensional array in an x-axis, y-axis plane, and there is a sufficient number of spacing bars to connect each hollow module to all x-axis and y-axis adjacent hollow modules.

15. The system of claim 11 wherein said spacing bars have a T-bar cross section so as to enhance strength of said spacing bars.

16. The system of claim 13 wherein said spacing bars have a T-bar cross section so as to enhance strength of said spacing bars.

17. The system of claim 14 wherein said hollow modules are aligned linearly, wherein there are N number of hollow modules and wherein there are N−1 number of spacing bars.

18. The system of claim 14 wherein said hollow modules are semi-spherical.

19. The system of claim 11 wherein said hollow modules are cylindrical.

20. The system of claim 11 wherein said hollow modules are elongated with rounded ends.

* * * * *